US007764267B2

(12) United States Patent
Shin et al.

(10) Patent No.: US 7,764,267 B2
(45) Date of Patent: Jul. 27, 2010

(54) LIQUID CRYSTAL DISPLAY APPARATUS AND METHOD OF DRIVING THE SAME

(75) Inventors: Seong-Sik Shin, Seongnam-si (KR); Jong-Seo Lee, Hwaseong-si (KR); Joo-Young Lee, Seoul (KR); Tae-Jong Jun, Youngin-si (KR); Jung-Suk Han, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 579 days.

(21) Appl. No.: 11/696,103

(22) Filed: Apr. 3, 2007

(65) Prior Publication Data

US 2007/0230207 A1 Oct. 4, 2007

(30) Foreign Application Priority Data

Apr. 4, 2006 (KR) ..... 10-2006-0030427

(51) Int. Cl.
*G09G 3/36* (2006.01)

(52) U.S. Cl. ..... 345/102; 362/561

(58) Field of Classification Search ..... 345/102; 362/561

See application file for complete search history.

(56) References Cited

U.S. PATENT DOCUMENTS

2001/0038371 A1 8/2001 Yoshinaga et al.
2006/0007102 A1 * 1/2006 Yasuoka et al. ..... 345/102
2006/0170645 A1 * 8/2006 Fisekovic et al. ..... 345/102

FOREIGN PATENT DOCUMENTS

CN 1628262 6/2005
WO 03/107083 A1 12/2003

OTHER PUBLICATIONS

EP 07006155 search report of Apr. 2, 2009.

* cited by examiner

*Primary Examiner*—David L Lewis
(74) *Attorney, Agent, or Firm*—Innovation Counsel LLP

(57) ABSTRACT

A liquid crystal display (LCD) apparatus time-divides a frame into a plurality of fields, in which lights having a color different from each other, are generated. The LCD apparatus includes a backlight unit. The backlight unit includes n of light-generating units sequentially generating the lights in the fields. An initial light-generating time of an nth light-generating unit being delayed by a predetermined time gap relative to the (n−1)th light-generating unit so that each of the fields includes a first period, in which one of the lights is generated, and a second period, in which at least two of the lights are generated. The light-generating units generate a peak light having a peak intensity in the first period. Thus, the intensity of light or the time period for which the light is generated, is controlled so that color mixing is minimized and color purity is improved.

24 Claims, 6 Drawing Sheets

LIQUID CRYSTAL DISPLAY APPARATUS AND METHOD OF DRIVING THE SAME

CROSS-REFERENCE TO RELATED APPLICATIONS

This application relies for priority upon Korean Patent Application No. 2006-30427 field on Apr. 4, 2006, the contents of which are herein incorporated by reference in its entirety.

FIELD OF THE INVENTION

The present invention relates to a liquid crystal display apparatus and, more particularly, to a liquid crystal display apparatus for displaying an image by using a frame divided into a plurality of fields.

DESCRIPTION OF THE RELATED ART

In a conventional liquid crystal display, a color image is displayed by selectively transmitting white light through three different color filters that are adjacent to each other at each pixel, thereby reducing the actual image resolution to ⅓ of the number of actual pixels as well as reducing the amount of light-transmittance and a color purity.

In order to alleviate these effects, a color filter-less (CFL) LCD apparatus driven by a time-division sequential driving method has been developed. A conventional color filter LCD apparatus displays a color image using a red color filter, a green color filter and a blue color filter. However, The CFL LCD apparatus driven by the time-division sequential driving method divides a frame into a plurality of fields sequentially generating lights having a color different from each other to display a desired color.

However, the light generated in each of the fields overlaps the light generated in an adjacent field causing an undesired mixing of the colors.

SUMMARY OF THE INVENTION

The present invention provides a liquid crystal display (LCD) apparatus capable of reducing color mixing to improve color purity. The present invention displays a color image by dividing each frame sequentially into a plurality of different color fields. The LCD apparatus includes n f light-generating units sequentially generating the lights in the fields, n being a natural number more than 1. An initial light-generating time of an nth light-generating unit being delayed by a predetermined time interval from the time of an (n−1)th light-generating unit so that each of the fields includes a first period, in which one of the lights is generated, and a second period, in which at least two of the lights is generated. The light-generating units generate a peak light having a peak intensity in the first period.

The light-generating units may be arranged in the direction of the gate lines and generate the lights for a time period substantially the same as each other. The predetermined time interval may be T1/n, T1 being the time period of each of the fields. The backlight unit may further include a light-generating controller to control the light-generating units. Each of the fields may be divided into n sub fields corresponding to the number of the light-generating units, so that the first light-generating unit stops generating the light corresponding to the end of an nth sub field.

Illustratively, the number of the light-generating units may be 8, and a first light-generating unit may generate the light in a fifth subfield, a sixth sub field, a seventh sub field and an eighth sub field of each of the fields. The first light-generating unit may generate the peak light in the eighth sub field. A second light-generating unit, a third light-generating unit and a fourth light-generating unit may generate the peak light in the eighth sub field. A fifth light-generating unit, a sixth light-generating unit, a seventh light-generating unit and an eighth light-generating unit may generate the peak light in a sub field corresponding to the initial light-generating time.

In another aspect of the present invention, an LCD apparatus time-divides a frame into a plurality of fields, in which lights having a color different from each other, are generated, to display an image. The LCD apparatus includes an LCD panel and a backlight unit. The LCD panel includes a plurality of gate lines and a plurality of data lines crossing the gate lines. The backlight unit includes n of light-generating units sequentially generating the lights in the fields, n being a natural number more than 1. An initial light-generating time of an nth light-generating unit being delayed by a predetermined time gap in comparison with an initial light-generating time of an (n−1)th light-generating unit. Each of the light-generating units generates at least one of the lights for a time period shorter than the remaining lights.

The light-generating units may be arranged in an arranging direction of the gate lines and generate the lights for a time period substantially same as each other. The time gap may be T1/n, T1 being a time period of each of the fields. The backlight unit may further include a light-generating controller to control the light-generating units. Each of the fields may be divided into n of sub fields corresponding to the number of the light-generating units, and a first light-generating unit closes generating the light corresponding to an end of an nth sub field.

For example, the number of the light-generating units is 8, and at least one of the lights may be generated for T1×(⅜), and the remained lights may be generated for T1×(⅝).

In still another aspect of the present invention, a method of driving an LCD apparatus is provided. In the method, an LCD apparatus time-divides a frame into a plurality of fields, in which lights having a color different from each other, are generated, to display an image. The lights are sequentially generated by n of light-generating units arranged in an arranging direction of a plurality of gate lines, n being a natural number more than 1. An initial light-generating time of an nth light-generating unit being delayed by T1/n, T1 being a time period of each of the fields, in comparison with an initial light-generating time of an (n−1)th light-generating unit so that each of the fields comprises a first period, in which one of the lights is generated, and a second period, in which at least two of the lights is generated. A time period, for which each of the lights is generated, is substantially same as each other. A peak light having a peak intensity is generated in the first period.

In further still another aspect of the present invention, a method of driving an LCD apparatus is provided. In the method, an LCD apparatus time-divides a frame into a plurality of fields, in which lights having a color different from each other, are generated, to display an image. The lights are generated by n of light-generating units arranged in an arranging direction of a plurality of gate lines, n being a natural number more than 1. An initial light-generating time of an nth light-generating unit being delayed by T1/n, T1 being a time period of each of the fields, in comparison with an initial light-generating time of an (n−1)th light-generating unit. At least one of the lights is generated for a time period shorter than remained lights.

According to the above, an intensity of light generated by a light-generating unit or a time period, for which the light is generated, is controlled. Thus, a color mixing may be minimized, and a color purity may be improved.

BRIEF DESCRIPTION OF THE DRAWINGS

The above and other advantages of the present invention will become readily apparent by reference to the following detailed description when considered in conjunction with the accompanying drawings wherein.

DESCRIPTION OF THE EMBODIMENTS

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
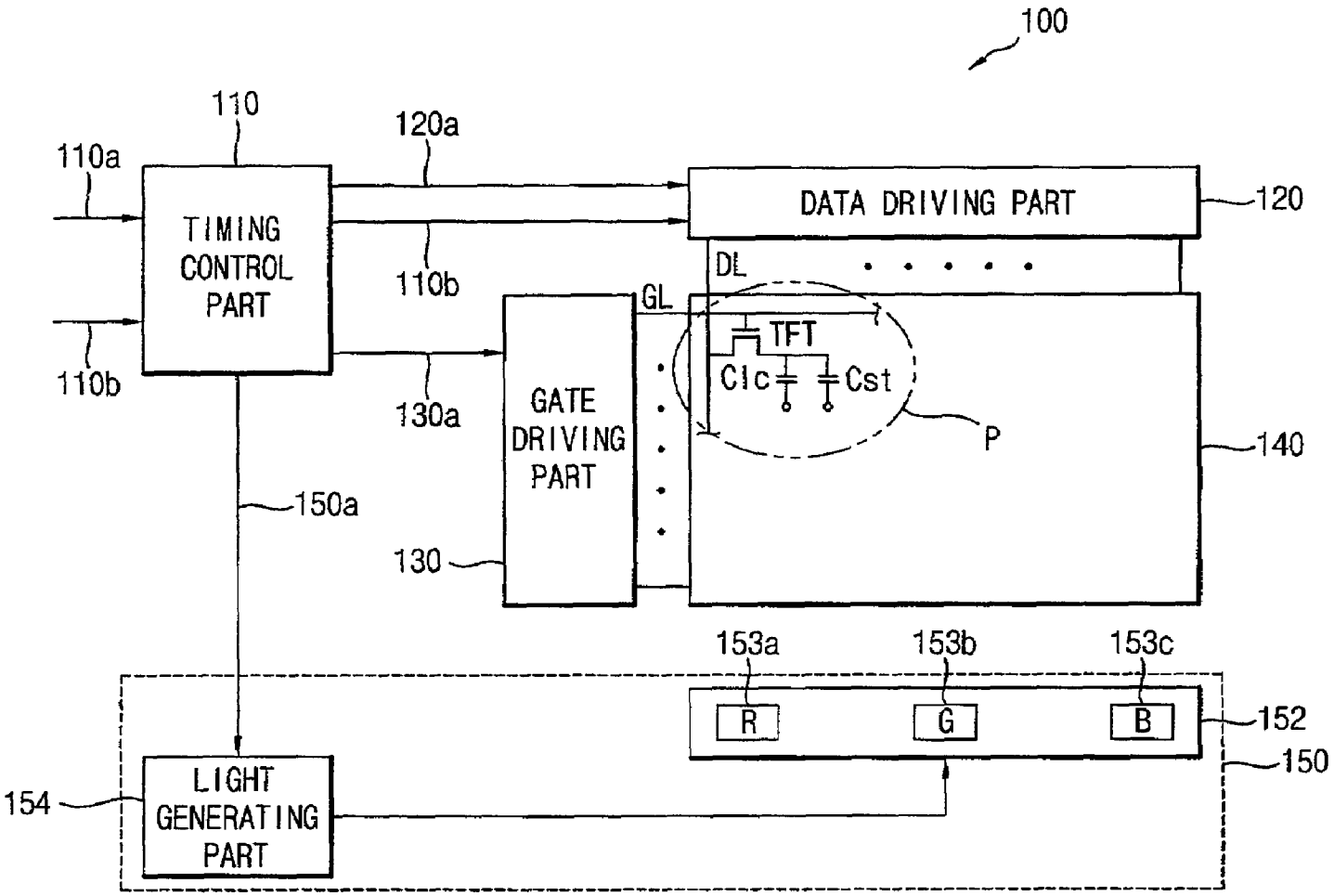
FIG. 1 is a block diagram illustrating a liquid crystal display (LCD) apparatus according to an exemplary embodiment of the present invention.
Figure 2:
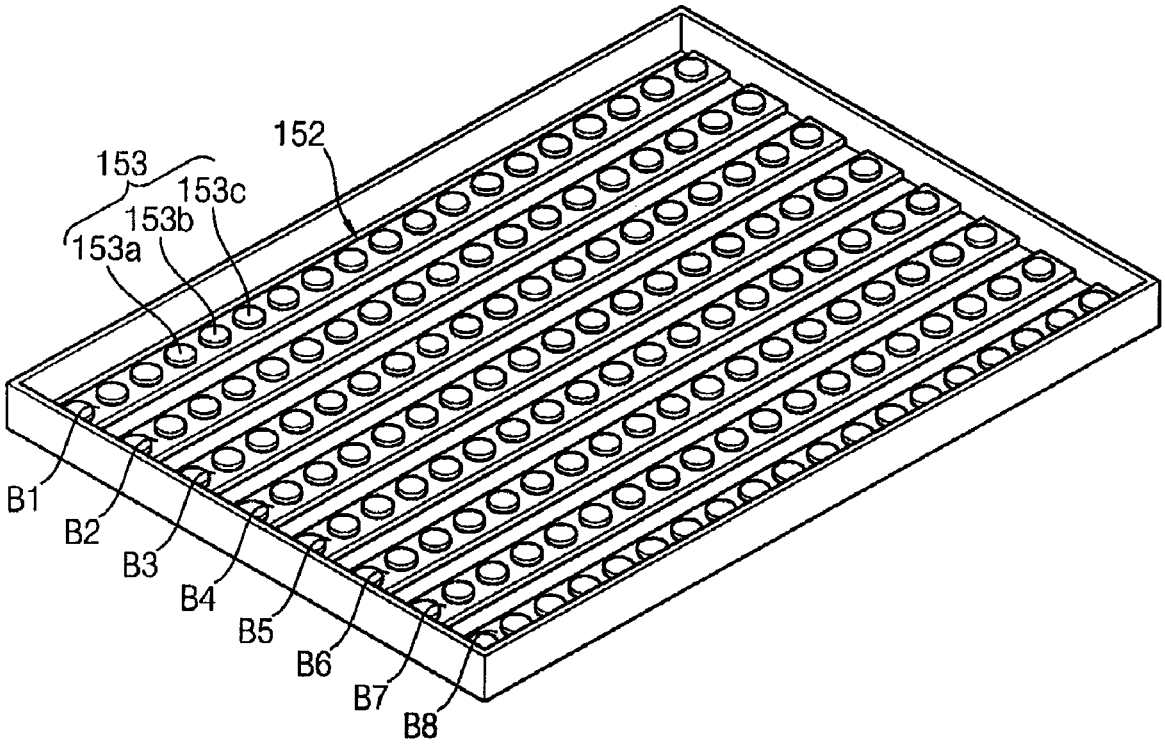
FIG. 2 is a perspective view illustrating light-generating units illustrated in FIG. 1.

Referring to FIGS. 1 and 2, an LCD apparatus 100 includes a timing control 110, a data driver 120, a gate driver 130, an LCD panel 140 and a backlight unit 150. When the LCD apparatus 100 is operated to display an image, a frame is time-divided into a plurality of fields sequentially displaying a color different from each other according to a time division driving method.

A timing control signal 110*a* and a data signal 110*b* is applied to the timing control 110 from an external device, such as a graphic controller, etc. The timing control 110 outputs control signals to drive the LCD apparatus 100 in response to the timing control signal 110*a*. For example, the timing control 110 may output a data control signal 120*a* to control the data driver 120, a gate control signal 130*a* to control the gate driver 130 and a backlight control signal 150*a* to control the backlight unit 150.

The data driver 120 converts the data signal 110*a* to an analog data voltage in response to the data control signal 120*a* applied to the data driver 120 from the timing control 110, and provides the LCD panel 140 with the converted data signal 110*a*.

The gate driver 130 generates a gate signal in response to the gate control signal 130*a* applied to the gate driver 130 from the timing control 110, and provides the LCD panel 140 with the gate signal.

The LCD panel 140 includes a first substrate (not shown) and a second substrate (not shown) that is coupled to the first substrate and receives a liquid crystal layer (not shown). The first substrate includes a plurality of gate lines GL and a plurality of data lines DL. A plurality of pixels P is defined by the gate lines GL and the data lines DL.

A switching device TFT, a liquid crystal capacitor Clc and a storage capacitor Cst are formed in each of the pixels P. The switching device TFT is electrically connected to the gate line GL and the data line DL. The liquid crystal capacitor Clc is electrically connected to the switching device TFT.

In this embodiment, the second substrate does not have a color filter.

The backlight unit 150 includes a plurality of light-generating units 152 to generate light and a light-generating control 154 to control the light-generating units 152.

The light-generating units 152 are arranged in an arranging direction of the gate lines GL of the LCD panel 140. For example, eight light-generating units 152 may be arranged in the arranging direction of the gate lines GL. Alternatively, the number of the light-generating units 152 may be varied. The light-generating units 152 are sequentially driven in the arranging direction of the gate lines GL by a predetermined time gap.

The light-generating units 152 are controlled by the light-generating control 154 to generate lights having a color different from each other corresponding to each of the fields. The light-generating unit 152 includes a plurality of light-generating devices 153. For example, the light-generating unit 152 may include a plurality of light-emitting diodes (LED). The light-generating device 153 includes a plurality of first light-generating devices 153*a* to generate a first light, a plurality of second light-generating devices 153*b* to generate a second light and a plurality of third light-generating devices 153*c* to generate a third light. For example, the first light may be red, and the second light may be green, and the third light may be blue. The first, second and third light-generating devices 153*a*, 153*b* and 153*c* are sequentially driven according to the time division driving method to sequentially generate the first, second and third lights.

Figure 3:
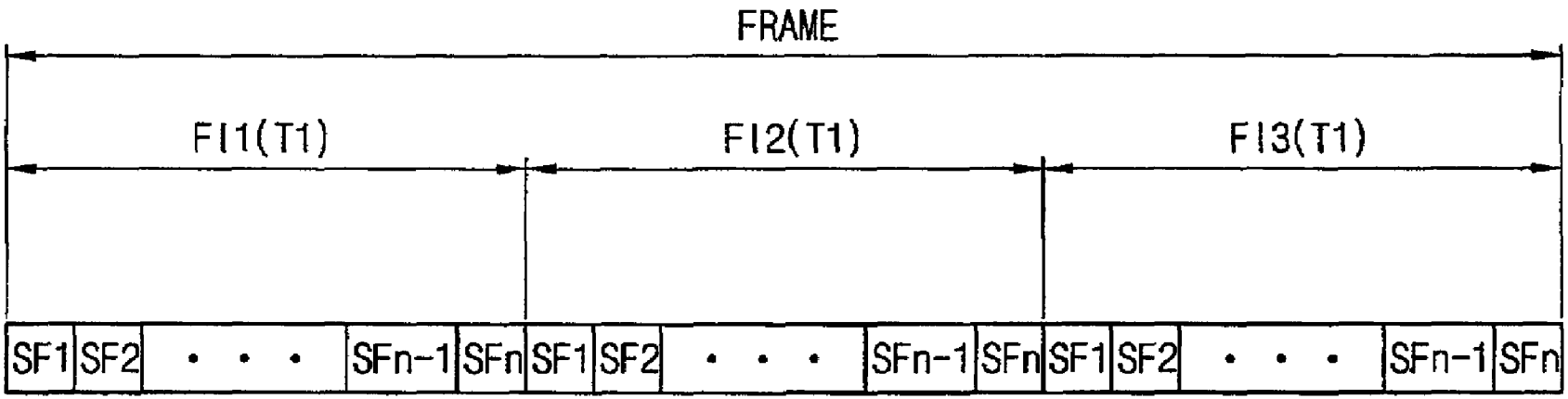
FIG. 3 is a schematic view explaining the timing of an LCD apparatus according to an exemplary embodiment of the present invention.
Figure 4:
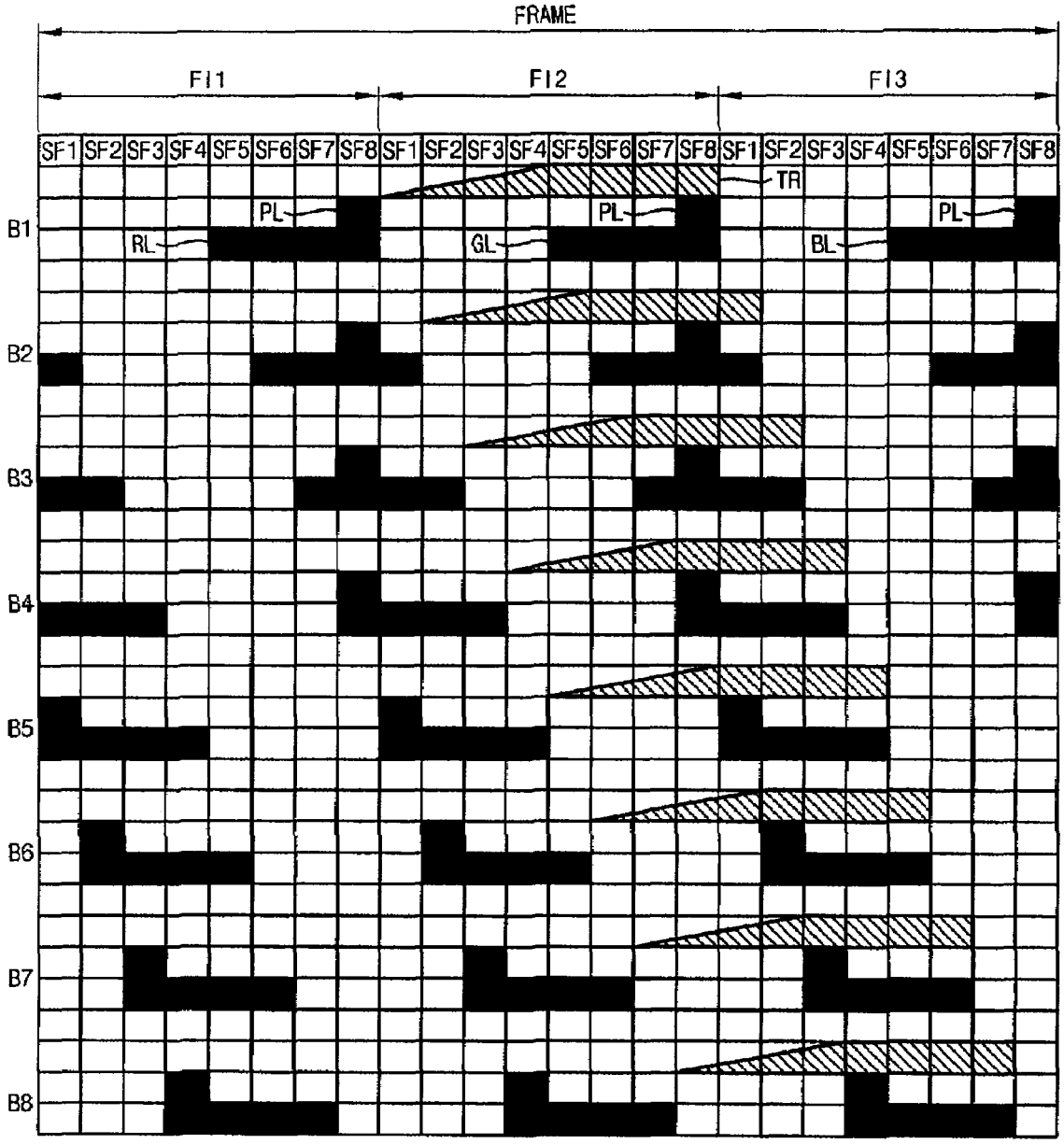
FIG. 4 is a timing diagram illustrating a method of driving the light-generating units according to the timing of FIG. 3.

FIG. 3 is a schematic view explaining the driver timing of an LCD apparatus according to an exemplary embodiment of the present invention. FIG. 4 is a timing diagram illustrating a method of driving the light-generating units according to the driver timing of FIG. 3.

Referring to FIGS. 1 to 4, when the LCD apparatus is operated, a frame is time-divided into a first field Fl1, a second field Fl2 and a third field Fl3. Each of the first, second and third fields Fl1, Fl2 and Fl3 is time-divided into a plurality of sub fields (SF1, . . . , SFn) corresponding to the number of the light-generating units 152.

An initial light-generating time of an nth light-generating unit is delayed by a predetermined time gap in comparison with an initial light-generating time of an (n−1)th light-generating unit. For example, when a time period of each of the first, second and third fields Fl1, Fl2 and Fl3 is T1, the initial light-generating time of the nth light-generating unit is delayed by T1 in comparison with the initial light-generating time of the (n−1)th light-generating unit. Each of the light-generating units 152 generates light for a predetermined time period.

A first light-generating unit B1 generates lights having a color different from each other for a predetermined time period corresponding to each of the first, second and third fields Fl1, Fl2 and Fl3. For example, the first light-generating unit B1 generates a red light RL in the first field Fl1, a green light GL in the second field Fl2 and a blue light BL in the third field Fl3. Alternatively, a light-generating order of the red, green and blue lights RL, GL and BL may be varied. The first light-generating unit B1 closes generating light corresponding to an end of a nth sub field. The nth sub field is a last sub field in each of the first, second and third fields Fl1, Fl2 and Fl3.

An initial light-generating time of a second light-generating unit B2 is delayed by a time period of one sub field in comparison with the initial light-generating time of the first light-generating unit B1. The second light-generating unit B2 generates light for a time period substantially same as the first light-generating unit B1.

The number of the light-generating units 152 may be varied. In this embodiment, the backlight unit 150 includes eight light-generating units 152. Referring to FIG. 4, when the backlight unit 150 includes eight light-generating units 152, each of the first, second and third fields Fl1, Fl2 and Fl3 is time-divided into eight sub fields SF1, SF2, SF3, SF4, SF5, SF6, SF7 and SF8. The first light-generating unit B1 generates light in four sub fields, for example, the fifth, sixth, seventh and eighth sub fields SF5, SF6, SF7 and SF8 in each of the first, second and third fields Fl1, Fl2 and Fl3. Alternatively, the first light-generating unit B1 may generate light in three sub fields, for example, the sixth, seventh and eighth sub fields SF6, SF7 and SF8 in each of the first, second and third fields Fl1, Fl2 and Fl3.

Thus, an initial light-generating time of each of a second light-generating unit B2, a third light-generating unit B3, a fourth light-generating unit B4, a fifth light-generating unit B5, a sixth light-generating unit B6, a seventh light-generating unit B7 and a eighth light-generating unit B8 is delayed by a time period of one sub field in comparison with an initial light-generating time of a prior light-generating unit, as the above.

The liquid crystal layer of the LCD panel 140 controls a transmittance of light in response to a data voltage applied to the LCD panel from the data lines DL. The liquid crystal layer may have a response speed base on the data voltage. Referring to FIG. 4, in view of the response speed of the liquid crystal layer, a time-transmittance TR of light passing through the LCD panel 140 slowly increases for a predetermined time period and is then saturated. Furthermore, since the gate lines GL are sequentially driven, the data voltages applied to the data line DL are delayed by a time block corresponding to each of the light-generating units 152.

Thus, when a time period, for which each of the light-generating units 152 generates the light, is synchronized with the time-transmittance TR of the light passing through the LCD panel 140, a light-using efficiency may be improved.

When the initial light-generating time of each of the light-generating units 152 are sequentially delayed, colors may be mixed with each other in each of the first, second and third fields Fl1, Fl2 and Fl3. For example, when a green needs to be displayed on a screen of the LCD panel 140, each of the light-generating units 152 is synchronized with the time-transmittance TR of the LCD panel 140 to generate the green light GL from the fifth sub field SF5 of the second field Fl2. However, each of the second, third, fourth, fifth, sixth, seventh and eighth light-generating units B2, B3, B4, B5, B6, B7 and B8 generates the red light RL in the second field Fl2. Thus, the red light RL affects the green light GL to deteriorate a purity of the green.

Furthermore, the first, second, third and fourth light-generating units B1, B2, B3 and B4 generates the blue light in the fifth, sixth, seventh and eighth sub fields SF5, SF6, SF7 and SF8 of the third field Fl3. Thus, the blue light affects the green light in the fifth, sixth and seventh sub fields SF5, SF6 and SF7 of the third field Fl3 to deteriorate the purity of the green.

In this embodiment, a peak light having a peak intensity is generated in a non-overlapped period, in which the lights having a color different from each other are not mixed with each other. Thus, a color mixing may be reduced.

Particularly, the first light-generating unit B1 generates the green light GL in the fifth, sixth, seventh and eighth sub fields SF5, SF6, SF7 and SF8 of the second field Fl2. The first light-generating unit B1 generates a peak light PL in the eighth sub field SF8. The peak light PL has an intensity greater than a light in the fifth, sixth and seventh sub fields SF5, SF6 and SF7, in which the red light RL is generated.

The second, third and fourth light-generating units B2, B3 and B4 generate the green light GL in the second and third fields Fl2 and Fl3.

The second light-generating unit B2 generates the green light GL in the sixth, seventh and eighth sub fields SF6, SF7 and SF8 of the second field Fl2 and in the first sub field SF1 of the third field Fl3. The second light-generating unit B2 generates a peak light PL having a peak intensity in the eighth sub field SF8 of the second field Fl2 or in the first sub field SF1 of the third field Fl3, in which the red light RL and the blue light BL are not generated. For example, the second light-generating unit B2 may generate the peak light PL in the eighth sub field SF8 of the second field Fl2.

The third light-generating unit B3 generates the green light GL in the seventh and eighth sub fields SF7 and SF8 of the second field Fl2 and in the first and second sub fields SF1 and SF2 of the third field Fl3. The third light-generating unit B3 generates a peak light PL having a peak intensity in one of the eighth sub field SF8 of the second field Fl2, the first sub field SF1 of the third field Fl3 and the second subfield SF2 of the third field Fl3, in which the red light RL and the blue light BL are not generated. For example, the third light-generating unit B3 may generate the peak light PL in the eighth sub field SF8 of the second field Fl2.

The fourth light-generating unit B4 generates the green light GL in the eighth sub fields SF8 of the second field Fl2 and in the first, second and third sub fields SF1, SF2 and SF3 of the third field Fl3. The fourth light-generating unit B4 generates a peak light PL having a peak intensity in one of the eighth sub fields SF8 of the second field Fl2 and the first, second and third sub fields SF1, SF2 and SF3 of the third field Fl3. For example, the fourth light-generating unit B4 may generate the peak light PL in the eighth sub field SF8 of the second field Fl2.

The fifth, sixth, seventh and eighth light-generating units B5, B6, B7 and B8 generate the green light GL in the third field Fl3 and a peak light PL in sub fields, in which the blue light BL is not generated. For example, the fifth, sixth, seventh and eighth light-generating units B5, B6, B7 and B8 generate the peak light PL in the sub field corresponding an initial light-generating time. Thus, the fifth light-generating units B5 generates the peak light PL in the first sub field SF1 of the third field Fl3, and the sixth light-generating units B6 generates the peak light PL in the second sub field SF2 of the third field Fl3, and the seventh light-generating units B7 generates the peak light PL in the third sub field SF3 of the third field Fl3, and the eighth light-generating units B8 generates the peak light PL in the fourth sub field SF4 of the third field Fl3.

Furthermore, the light-generating units 152 may further generate peak lights PL of the red light RL and the blue light BL. For example, the fifth, sixth, seventh and eighth light-generating units B5, B6, B7 and B8 may generate the peak light PL of the red light RL in the second field Fl2. The peak light PL of the red light RL generated by the fifth, sixth, seventh and eighth light-generating units B5, B6, B7 and B8 corresponds to subfields, in which the time-transmittance of the LCD panel 140 is relatively small. Thus, the green light GL is lightly affected by the red light RL.

When a frame is time-divided into a plurality of fields, a peak light having a peak intensity may be generated in the non-overlapped period, in which the lights having a color different from each other are not mixed with each other to reduce a color mixing.

Figure 5:
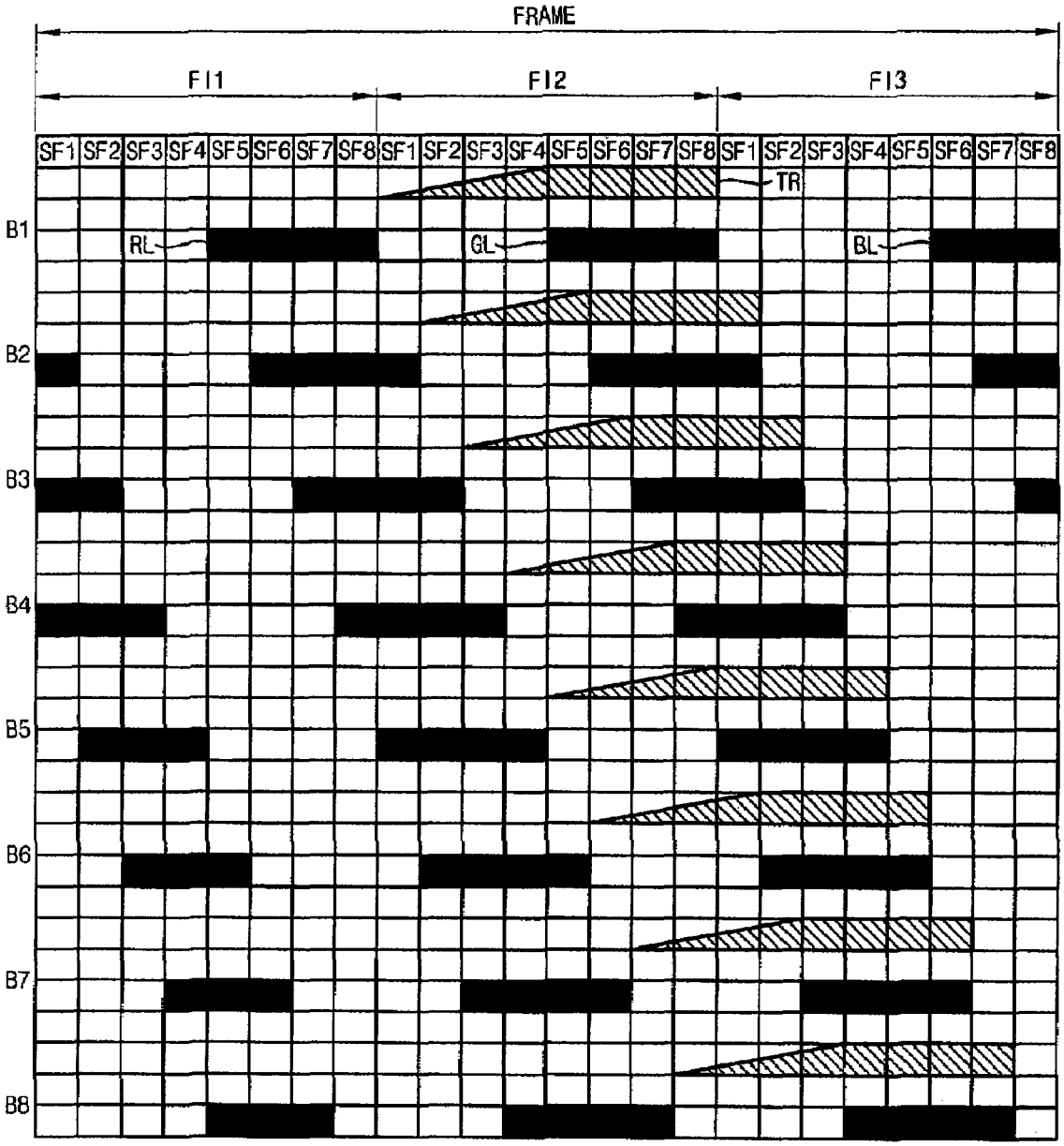
FIG. 5 is a timing diagram illustrating a method of driving the light-generating units according to another exemplary embodiment of the present invention.

FIG. 5 is a timing diagram illustrating a method of driving the light-generating units according to another exemplary embodiment of the present invention.

Referring to FIGS. 1, 2 and 5, the first light-generating unit B1 generates a plurality of lights having a color different from each other in each of the first, second and third fields Fl1, Fl2 and Fl3. For example, the first light-generating unit B1 generates the red light RL in the first field Fl1, the green light GL in the second field Fl2 and the blue light BL in the third field Fl3. Alternatively, a light-generating order of the red, green and blue lights RL, GL and BL may be varied. The first light-generating unit B1 closes generating the light corresponding to an end of the eighth sub field SF8 in each of the first, second and third fields Fl1, Fl2 and Fl3. The eighth sub field SF8 corresponds to a last sub field in each of the first, second and third fields Fl1, Fl2 and Fl3.

An initial light-generating time of each of the second, third, fourth, fifth, sixth, seventh and eighth light-generating units B2, B3, B4, B5, B6, B7 and B8 is sequentially delayed by a time period of one sub field in comparison with a prior light-generating unit, and generates the light for a time period substantially same as the first light-generating unit B1.

In this embodiment, the light in one of the first, second and third fields Fl1, Fl2 and Fl3 is generated for a relatively short time period in comparison with remained fields. Thus, the color mixing may be reduced. Particularly, time periods, for which the red, green and blue light RL, GL and BL are generated, are different from each other to adjust the color mixing.

For example, when the backlight unit 150 includes eight light-generating units 152, the first light-generating unit B1 generates the lights for T1×(4/8) in one of the first, second and third fields Fl1, Fl2 and Fl3, which corresponds to a desired color, and for T1×(3/8) in at least one of remained fields.

Particularly, the first light-generating unit B1 generates the red light RL in the fifth, sixth, seventh and eighth sub fields SF5, SF6, SF7 and SF8 of the first field Fl1, and generates the green light GL in the fifth, sixth, seventh and eighth sub fields SF5, SF6, SF7 and SF8 of the second field Fl2, and generates the blue light BL in the sixth, seventh and eighth sub fields SF6, SF7 and SF8 of the third field Fl3. Thus, the first light-generating unit B1 generates the red and green lights RL and GL in four sub fields, and generates the blue light BL in three sub fields.

An initial light-generating time of each of the second, third, fourth, fifth, sixth, seventh and eighth light-generating units B2, B3, B4, B5, B6, B7 and B8 is sequentially delayed by a time period of one sub field in comparison with a prior light-generating unit, and generates the light for a time period substantially same as the first light-generating unit B1.

Referring to FIG. 5, when the green needs to be displayed on the screen of the LCD panel 140, the blue light BL affects the green light GL in the sixth and seventh sub fields SF6 and SF7 of the third field Fl3. However, the affection is relatively light in comparison with the case that the blue light BL generated in four sub fields of the third field Fl3 affects the green light GL in the fifth, sixth and seventh sub fields SF5, SF6 and SF7 of the third field Fl3.

Furthermore, the time periods, for which both of the red light RL and the blue light BL are generated, may be reduced so that the green light GL is lightly affected by the red light RL and the blue light BL. Thus, the color mixing may be reduced.

As the above, when the light-generating units 152 are controlled so that the time periods, for which the red, green and blue lights RL, GL and BL are generated, are different from each other, the color mixing may be desirably controlled. Thus, the color mixing perceived by an observer may be minimized.

Figure 6:
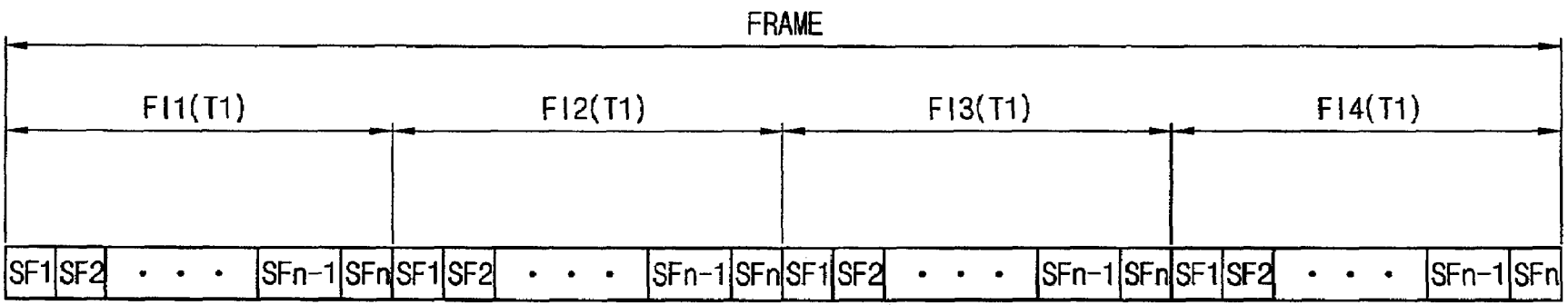
FIG. 6 is a schematic diagram explaining the timing of an LCD apparatus according to another exemplary embodiment of the present invention.

FIG. 6 is a schematic diagram explaining driver timing of an LCD apparatus according to another exemplary embodiment of the present invention.

Referring to FIGS. 1, 2 and 6, a frame of an LCD apparatus 100 is time-divided into a first field Fl1, a second field Fl2, a third field Fl3 and a fourth field Fl4. Each of the first, second, third and fourth field Fl1, Fl2, Fl3 and Fl4 is time-divided into a plurality of sub fields SF1, . . . , SFn corresponding to the number of light-generating units 152.

Each of the light-generating units 152 sequentially generates lights having a color different from each other corresponding to each of the first, second, third and fourth field Fl1, Fl2, Fl3 and Fl4. For example, the light-generate units 152 may generate a red light in the first field Fl1, a green light in the second field Fl2, a blue light in the third field Fl3 and a white light in the fourth field Fl4. Alternatively, a light-generating order of the red, green, blue and white lights may be varied.

Each of the light-generating units 152 may include a red LED 153*a*, a green LED 153*b* and a blue LED 153*c* in order to generate the red, green and blue lights. Each of the light-generating units 152 may simultaneously generate the red, green and blue lights to display the white light. Alternatively, each of the light-generating units 152 may further include a white LED.

Each of the light-generating units 152 are driven by substantially the same as the driving method illustrated in FIG. 4 or 5 except that the frame is time-divided into four fields. Thus, any further explanation concerning the same elements will be omitted.

According to the above, a peak light having a peak intensity is generated in a non-overlapped period in which the different color lights are not mixed with each other and the color of the peak light is enhanced.

Furthermore, an LCD apparatus is controlled so that time periods for which the lights are of different color from each other are generated, are different.

Although the exemplary embodiments of the present invention have been described, it is understood that various changes and modifications can be made by one ordinary skilled in the art without, however, departing from the spirit and scope of the present invention.

What is claimed is:

1. A liquid crystal display (LCD) apparatus in which a frame is divided into a plurality of fields in which different color lights are generated, comprising:

a backlight unit comprising n of light-generating units sequentially generating the lights in the fields, n being a natural number more than 1, an initial light-generating time of the nth light-generating unit being delayed by a predetermined time interval compared to the initial light-generating time of the (n−1)th light-generating unit so that each of the fields comprises a first period in which one of the lights is generated and a second period in which at least two of the lights are generated, the light-generating units generating a peak light having a peak intensity in the first period.

2. The LCD apparatus of claim 1, wherein the light-generating units generate the lights for a time period substantially the same as each other, the predetermined time interval is T1/n, T1 being the time period of each of the fields.

3. The LCD apparatus of claim 1, wherein the backlight unit further comprises a light-generating controller to control the light-generating units.

4. The LCD apparatus of claim 2, wherein each of the fields is divided into n sub fields corresponding to the number of the light-generating units, and the first light-generating unit stops generating the light at the end of the nth sub field.

5. The LCD apparatus of claim 4, wherein the number of the light-generating units is 8, and the first light-generating unit generates the light in a fifth subfield, a sixth sub field, a seventh sub field and an eighth sub field of each of the fields.

6. The LCD apparatus of claim 5, wherein the first light-generating unit generates the peak light in the eighth sub field.

7. The LCD apparatus of claim 6, wherein a second light-generating unit, a third light-generating unit and a fourth light-generating unit generates the peak light in the eighth sub field.

8. The LCD apparatus of claim 6, wherein a fifth light-generating unit, a sixth light-generating unit, a seventh light-generating unit and an eighth light-generating unit generates the peak light in a sub field corresponding to the initial light-generating time.

9. The LCD apparatus of claim 2, wherein each of the light-generating units comprises a red light-emitting diode (LED), a green LED and a blue LED.

10. The LCD apparatus of claim 9, wherein each of the light-generating units sequentially generates a red light, a green light and a blue light respectively corresponding to each of the fields in the frame.

11. The LCD apparatus of claim 9, wherein each of the light-generating units sequentially generates a red light, a green light, a blue light and a white light respectively corresponding to each of the fields in the frame.

12. A liquid crystal display (LCD) apparatus to time-divide a frame into a plurality of fields in which different color lights are generated, the apparatus comprising:

an LCD panel comprising a plurality of gate lines and a plurality of data lines crossing the gate lines; and a backlight unit comprising n light-generating units sequentially generating the lights in the fields, n being a natural number more than 1, an initial light-generating time of an nth light-generating unit being delayed by a predetermined time interval compared to an initial light-generating time of an (n−1)th light-generating unit wherein each of the light-generating units generates at least one of the lights for a time period shorter than the remaining ones of the lights.

13. The LCD apparatus of claim 12, wherein the light-generating units are arranged in an arranging direction of the gate lines and generate the lights for a time period substantially same as each other, and the time gap is T1/n, T1 being a time period of each of the fields, and the backlight unit further comprises a light-generating controller to control the light-generating units.

14. The LCD apparatus of claim 13, wherein each of the fields is divided into n of sub fields corresponding to the number of the light-generating units, and a first light-generating unit closes generating the light corresponding to an end of an nth sub field.

15. The LCD apparatus of claim 14, wherein each of the light-generating units generate at least one of the lights for T1×(3/8) and generates the remained lights for T1×(4/8).

16. The LCD apparatus of claim 13, wherein each of the light-generating units comprises a red light-emitting diode (LED), a green LED and a blue LED.

17. The LCD apparatus of claim 15, wherein each of the light-generating units sequentially generates a red light, a green light and a blue light respectively corresponding to each of the fields in the frame.

18. The LCD apparatus of claim 17, wherein each of the light-generating units sequentially generates a red light, a green light, a blue light and a white light respectively corresponding to each of the fields in the frame.

19. A driving method of a liquid crystal display (LCD) apparatus to time-divide a frame into a plurality of fields in which lights having different colors from each other are generated, the method comprising:

sequentially generating the lights, the lights being generated by n light-generating units arranged in a plurality of gate lines, n being a natural number more than 1, an initial light-generating time of an nth light-generating unit being delayed by T1/n, T1 being the time period of each of the fields compared to the initial light-generating time of an (n−1)th light-generating unit so that each of the fields comprises a first period, in which one of the lights is generated and a second period in which at least two of the lights are generated, the time period for which each of the lights is generated being substantially the same, the peak light intensity being generated in the first period.

20. The method of claim 19, wherein each of the fields is divided into n of sub fields corresponding to the number of the light-generating units, and a first light-generating unit stops generating the light at the end of the nth sub field.

21. The method of claim 20, wherein the number of the light-generating units is 8, and the first light-generating unit generates the light in a fifth subfield, a sixth sub field, a seventh sub field and an eighth sub field of each of the fields, and the first light-generating unit, a second light-generating unit, a third light-generating unit and a fourth light-generating unit generates the peak light in the eighth sub field, and a fifth light-generating unit, a sixth light-generating unit, a seventh light-generating unit and an eighth light-generating unit generates the peak light in a sub field corresponding to the initial light-generating time.

22. A driving method of a liquid crystal display (LCD) apparatus to time-divide a frame into a plurality of fields, in which lights having a color different from each other, are generated, the method comprising:

sequentially generating the lights, the lights being generated by n of light-generating units arranged in an arranging direction of a plurality of gate lines, n being a natural number more than 1, an initial light-generating time of an nth light-generating unit being delayed by T1/n, T1 being a time period of each of the fields, in comparison with an initial light-generating time of an (n−1)th light-generating unit wherein at least one of the lights is generated for a time period shorter than remained lights.

23. The method of claim 22, wherein each of the fields is divided into n of sub fields corresponding to the number of the light-generating units, and a first light-generating unit closes generating the light corresponding to an end of an nth sub field.

24. The method of claim 23, wherein the number of the light-generating units is 8, and at least one of the lights is generated for T1×(3/8), and the remained lights are generated for T1×(4/8).

* * * * *